US005765715A

United States Patent [19]

Hughes

[11] Patent Number: 5,765,715

[45] Date of Patent: Jun. 16, 1998

[54] DRINKING CUP AND CUP HOLDER

[75] Inventor: Robert J. Hughes, North Easton, Mass.

[73] Assignee: The First Years Inc., Avon, Mass.

[21] Appl. No.: 820,808

[22] Filed: Mar. 19, 1997

[51] Int. Cl.[6] ..... B65D 23/02; B65D 8/22

[52] U.S. Cl. ..... 220/737; 220/739; 220/413; 220/410

[58] Field of Search ..... 220/410, 412, 220/413, 737, 739, 903

[56] References Cited

U.S. PATENT DOCUMENTS

| | | | |
|---|---|---|---|
| 3,013,691 | 12/1961 | Prentice | 220/739 |
| 4,928,873 | 5/1990 | Johnson | 220/739 |
| 5,186,350 | 2/1993 | McBride | 220/739 |
| 5,467,891 | 11/1995 | Perry | 220/739 |
| 5,551,592 | 9/1996 | Barton et al. | 220/739 |
| 5,573,141 | 11/1996 | Chen | 220/739 |

*Primary Examiner*—Joseph M. Moy
*Attorney, Agent, or Firm*—Fish & Richardson P.C.

[57] ABSTRACT

A drinking cup and a cup holder having mating radially extending flanges and tabs permitting the cup to be inserted into and removed from the holder in one rotative position of the cup and in a second rotative position of the cup permitting engagement of the flanges and tabs to secure the cup and holder together.

26 Claims, 3 Drawing Sheets

DRINKING CUP AND CUP HOLDER

This invention relates to drinking cups and cup holders, particularly for infants and young children.

Decorative cup holders, particularly those molded in the shape of fanciful characters are appealing to young children. Additionally, the size of a cup holder can provide desirable stability to a drinking cup because of the increased size of the face of the combined unit.

In general, the present invention comprises a cup and cup holder which can be securely assembled for use and which can be disassembled for cleaning. The cup and cup holder have mating tabs and flanges such that in one rotative position of the cup relative to the holder, the cup can be inserted into or removed from the holder. In a second rotative position, the tabs on the cup engage the cup holder flanges to secure the cup in the holder.

In particular embodiments, the cup has an extension below its main body. The extension has a diameter smaller than that of the body and the tabs extend outwardly from the body. The flanges on the cup holder extend inwardly such that in the second locked rotative position of the cup in the holder, the flanges are positioned between the tabs and the bottom of the main body of the cup. Protrusions on the lower side of the flanges and at one end of each flange limit rotation of the cup beyond the position in which the tabs are fully engaged with the flanges.

In one embodiment, bosses or detents are provided on the flanges engaging corresponding bosses or detents on facing surfaces of the cup. In particular, the flanges have a thickness in an axial direction equal to the distance between the bottom of the cup main body and the facing surface of the tab so that the flange engages both surfaces in the second rotative position of the cup. The bosses or detents on the flanges are positioned on the upper surfaces thereof and the bosses or detents on the cup are at the bottom of the cup main body. The bosses preferably are radially extending ribs and the detents are radial extending grooves. Thus, in the second rotative position or locked position of the cup in the holder there is a positive locking when the flanges and tabs are engaged and the engagement of the bosses and the detents provide a tactile indication of the locked condition.

The invention relates also to the features as indicated above of each of the cup and the cup holder.

Advantageously, the cup is positively locked in the holder in use, thereby preventing accidental removal of the cup from the holder. On the other hand, the cup can be removed for cleaning both of the cup and the interior of the holder.

Other features and advantages of the invention will be apparent from the following detailed specification taken together with the accompanying drawings in which.

Figure 1:
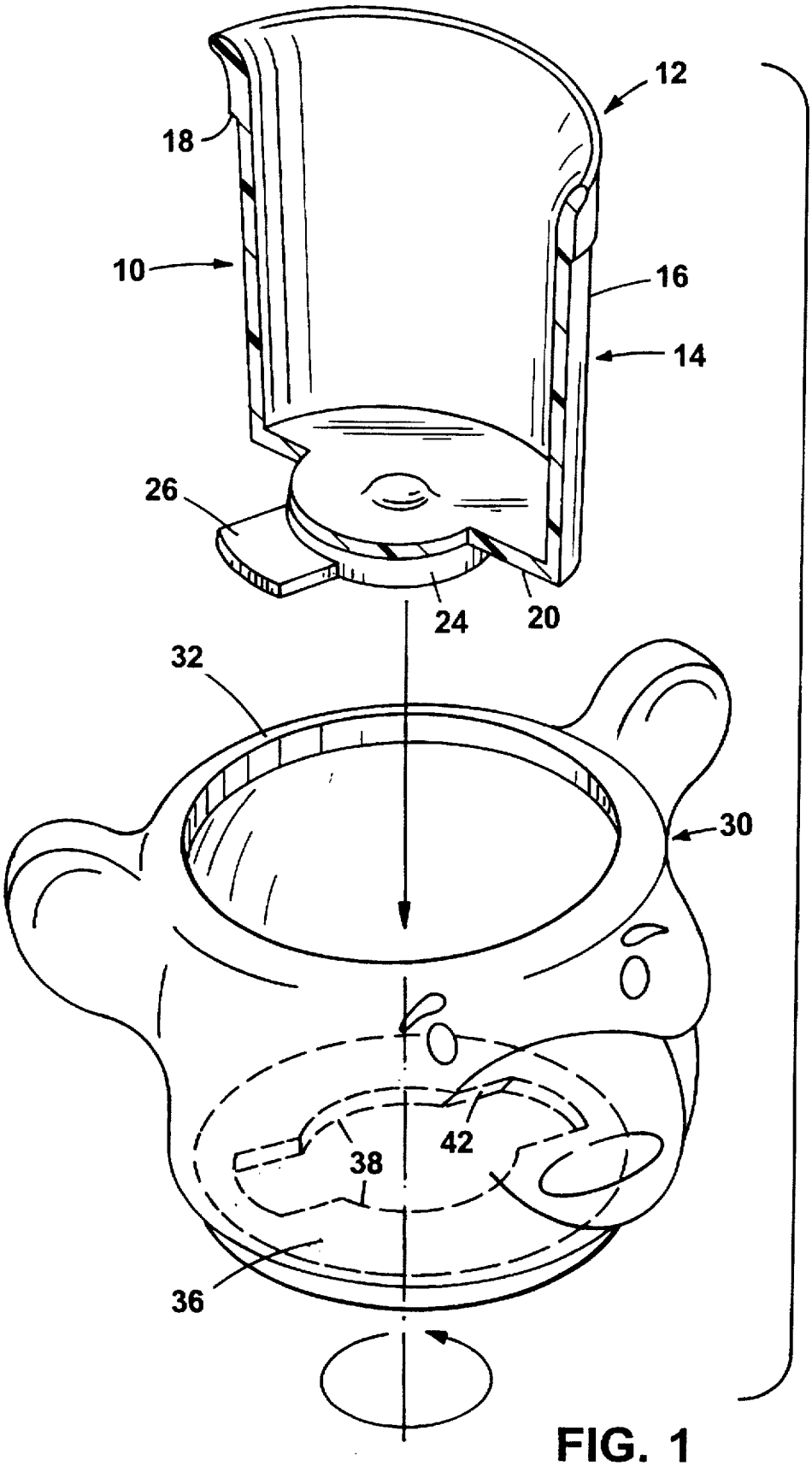
FIG. 1 is an exploded, partially sectional view, of a cup and cup holder embodying the invention.
Figure 2:
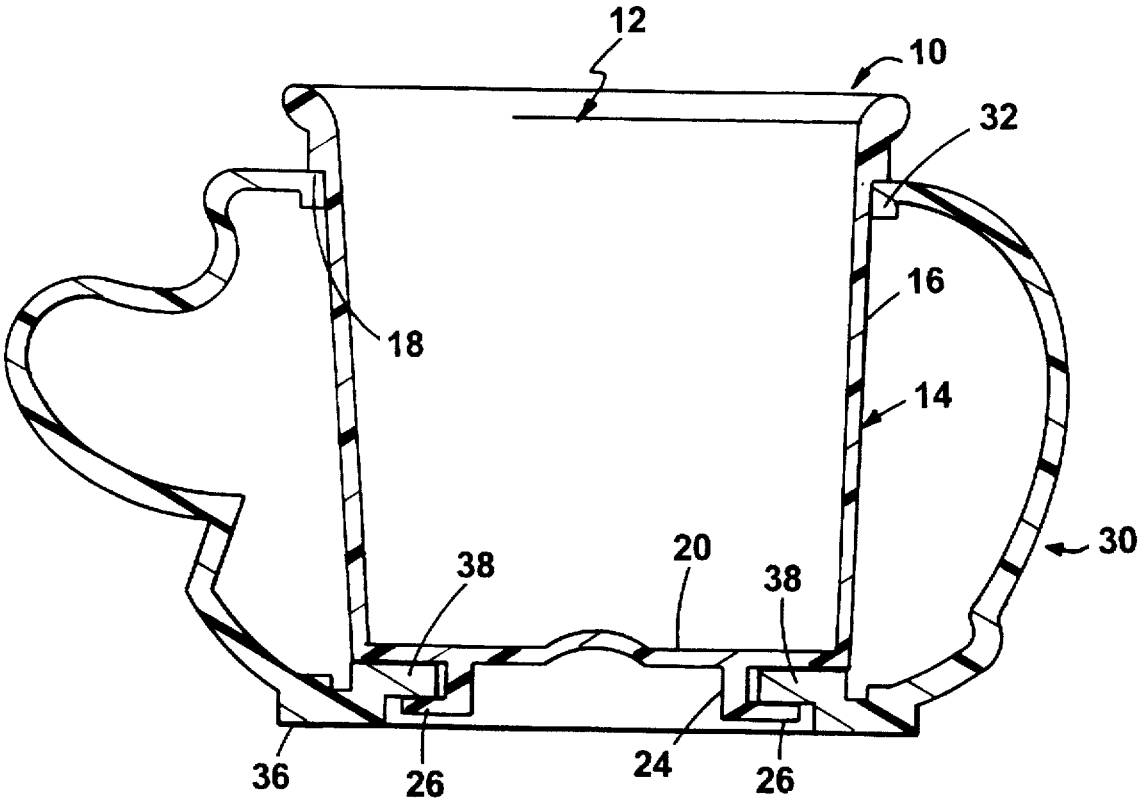
FIG. 2 is a sectional view of the assembled cup and cup holder locked together.

The cup 10 and cup holder 30 are illustrated in FIGS. 1 and 2. Turning first to the cup 10, the cup comprises a top

Figure 6:
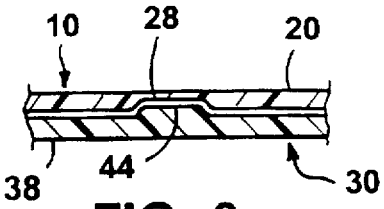
FIG. 6 is a sectional view along the line 6—6 of FIG. 4 of a feature of an alternate embodiment of the invention.
Figure 7:
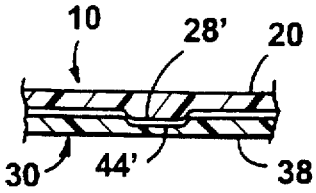
FIG. 7 is a sectional view similar to FIG. 6 of a second alternate embodiment of the invention.

12 and a main body portion 14, the sides 16 of which comprise a generally cylindrical wall of the cup. The sides 16 are recessed slightly from the cup top 12 to provide a ledge 18 extending about the upper portion of the cup. The main body 14 of the cup has a circular cross section. At the bottom 20 of the main body of the cup, a short cylindrical extension 24 is provided having a diameter substantially smaller than the outer diameter of the bottom 20 of the cup main body 14. A pair of tabs 26 shown in FIGS. 2, 3 and 4 spaced from the bottom of the cup main body 14 are provided on opposite sides of the extension 24, the tabs having limited circumferential dimensions such that the tabs interrupt only portions of the circular bottom wall of the extension 24 with which the tabs are co-planar. Shallow detents or radial extending grooves 28, as illustrated in FIG. 6, may optionally be provided in alignment with tabs 26 on the bottom of the main body of the cup. Alternatively, bosses or ribs 28' may be provided on the bottom of the main body of the cup, as shown in FIG. 7, instead of detents or grooves 28. As other alternatives, detents or grooves or bosses or ribs may be provided instead on the upper surfaces of the tabs.

Figure 5:
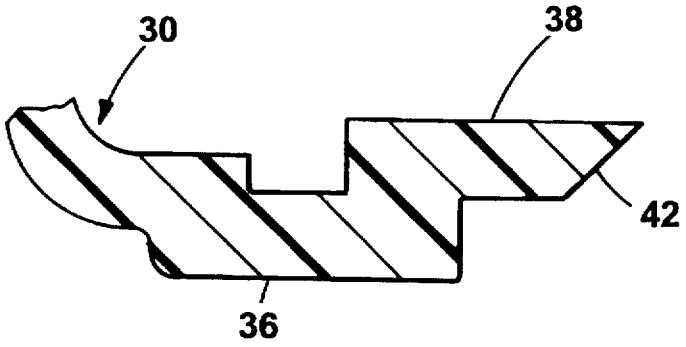
FIG. 5 is a sectional view of the bottom of the cup holder taken along the line 5—5 of FIG. 4.

The cup holder 30 as shown in FIGS. 1 and 2 has an open top 32, sides 34 and a bottom 36. The open top 32 of the holder has a diameter equal to that of the cup main body just below and adjacent the ledge 18. Thus when assembled with the cup, the ledge 18 engages the top 32 of the holder 30. The bottom 36 of the holder 30 has an opening somewhat larger than the dimensions of the extension 24 and tabs 26 of the cup. On opposite sides of the opening in the bottom of the holder, a pair of flanges 38 are provided as shown in FIGS. 1, 2, 3 and 4. The flanges 38 are recessed from the bottom 36 of the holder, as shown in FIG. 2, and extend inwardly to a position closely adjacent the position of the cup extension 24 when the cup is inserted into the holder. The flanges 38 have limited circumferential dimensions such that the extension 24 and tabs 26 of the cup can be inserted past the flanges. Flanges 38 are thus positioned below the bottom 20 of the cup main body 14 and the flanges 38 thus extend between the bottom 20 of the cup main body and the tabs 26 when the cup is rotated to a locking position. The bottom surface of the flanges engages the upper surfaces of the tabs in a locking position with the ledge 18 of the cup top resting on the top 32 of the holder. The flanges 38 have a thickness in an axial direction substantially equal to the axial distance between the bottom 20 of the cup main body 14 and the facing surfaces of the tabs 26 such that the flanges 38 engage both the tabs 26 and the bottom 20 of the cup main body 14 when the cup is rotated into a locking position. Flanges 38 are provided with protrusions 40 at one end thereof, the protrusions extending from the flanges 38 toward the holder bottom. The protrusions function to limit rotation of the cup in either direction to a fully locked or fully unlocked position. At their opposite ends 42 the flanges 38 are angled as best shown in FIG. 5 to facilitate movement of tabs 26 from an unlocked to a locked position with tabs 26 overlying flanges 38. In a particular embodiment, raised bosses or radially extending ribs 44 are optionally provided on the upper surfaces of the flanges 38, as shown in FIG. 6, to engage the detents or grooves 28 in the cup bottom 20 when the cup is rotated into a locking position. In the alternate embodiments mentioned in connection with the cup, detents or grooves 44' may be substituted for the bosses or ribs 44, as shown in FIG. 7, or the bosses or ribs or grooves and detents may be placed on the lower surfaces of the flanges.

The cup is formed of injection molded plastic such as polypropylene copolymer. The cup holder may be rotationally molded of plastic such as polyvinyl chloride. These molding techniques are well known to those skilled in the art.

Figure 3:
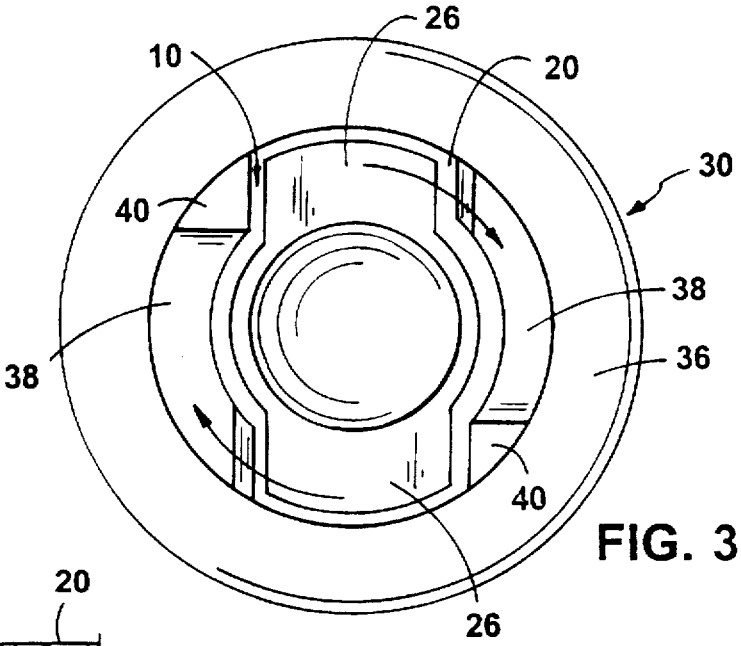
FIG. 3 is a bottom view of the assembled cup and cup holder in an unlocked position.
Figure 4:
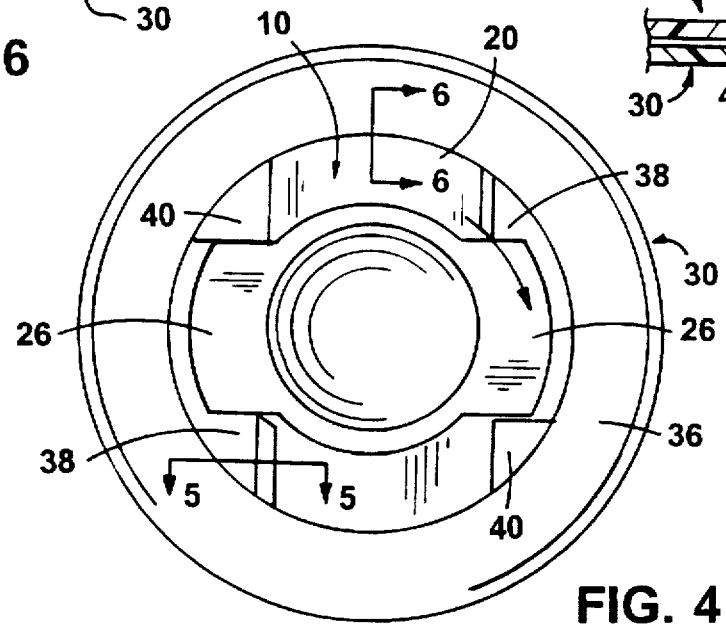
FIG. 4 is a bottom view similar to FIG. 3 with the cup and cup holder locked together.

In use, the cup is inserted into the holder with extension 24 and tabs 26 extending through the opening in the bottom 36 of the holder and with ledge 18 of the cup resting on the top 32 of the holder as shown in FIG. 3. The cup is then rotated to engage the tabs 26 and flanges 38, protrusions 40 providing a positive stop when the tabs and flanges are engaged as shown in FIG. 4. Detents and bosses 28, 28', 44, 44', if employed, further provide positive locking and also provide a tactile indication of locking. The drinking cup may then be used. To disassemble the cup and the holder, the cup is simply rotated in the opposite direction, disengaging any detents or bosses, protrusions 40 stopping rotation at the position at which the tabs 26 are aligned with the opening in the bottom of the holder. When the opening in the bottom of the holder is aligned with tabs 26 of the cup, the cup can then be lifted from the holder and both can then be properly cleaned.

Other embodiments of the invention are within the scope of the following claims.

What is claimed is:

1. In combination, a drinking cup and a cup holder;

the cup having a main body with a top, sides and a bottom and the cup further having below the top of the cup at least one radially outwardly extending tab;

the cup holder having a top, sides and a bottom, the top of the cup holder having an opening for receiving the cup within the holder and the holder having at least one flange extending radially inwardly at a position above and adjacent the position of the tab with the cup inserted into the holder;

each flange and each tab having limited circumferential dimensions permitting each tab to pass by each flange in one rotative position of the cup to permit insertion of the cup into and removal of the cup from the holder and permitting each flange to engage the upper surface of a tab in a second rotative position of the cup in the holder to secure the cup and the holder together.

2. The cup and holder claimed in claim 1 in which the cup has a plurality of tabs and the holder has corresponding plurality of flanges.

3. The cup and holder claimed in claim 2 in which the cup has a pair of tabs and the holder has a pair of flanges.

4. The cup and holder claimed in claim 3 in which the tabs are on opposite sides of the cup and in which the flanges are on opposite sides of the holder.

5. The cup and holder claimed in claim 1 in which the lower surface of at least one flange has a downwardly extending protrusion at one end limiting rotation of the cup upon engagement of one tab with the protrusion.

6. The cup and holder claimed in claim 1 in which the cup has an axial extension below the bottom of the cup main body of the cup, the extension has a diameter smaller than that of the body and each tab extends radially outwardly from the extension at a position axially spaced below the bottom of the cup body.

7. The cup and holder claimed in claim 6 in which each flange extends inwardly from the sides of the holder adjacent and is spaced above the bottom of the holder, each flange inwardly extending to a position below the bottom of the cup main body, each flange thereby positioned between one tab and the bottom of the cup main body in the second rotative position of the cup in the holder.

8. The cup and holder claimed in claim 7 in which each flange has a thickness in an axial direction substantially equal to the axial distance between the bottom of the cup main body and the facing surface of each tab.

9. The cup and holder claimed in claim 8 in which a boss or detent is provided on one surface of at least one flange and a mating boss or detent is provided on a facing surface of the cup.

10. The cup and holder claimed in claim 9 in which the boss or detent on the flange is positioned on the upper surface thereof and the boss or detent on the cup is positioned at the bottom of the cup main body.

11. The cup and holder claimed in claim 10 in which the boss is a radially extending rib and the detent is a radially extending groove.

12. A drinking cup adapted for removable insertion into and locking engagement with a cup holder;

the cup having a main body with a top, sides and a bottom and further having below the top at least one radially extending tab for engagement with a portion of said cup holder, each tab having a limited circumferential dimension.

13. The cup claimed in claim 12 in which the cup has a plurality of tabs.

14. The cup claimed in claim 13 in which the cup has a pair of tabs.

15. The cup claimed in claim 14 in which the tabs are on opposite sides of the cup.

16. The cup claimed in claim 12 in which the cup has an axial extension below the bottom of the cup main body, the extension has a diameter smaller than that of the body and each tab extends radially outwardly from the extension at a position axially spaced below the bottom of the cup body.

17. The cup claimed in claim 16 in which a boss or detent is provided on one surface of a tab.

18. The cup claimed in claim 17 in which the boss or detent is positioned at the bottom of the cup main body.

19. The cup claimed in claim 18 in which the boss or detent comprises a radially extending rib or groove.

20. A cup holder for removably receiving into and locking engagement with a drinking cup;

the holder having a top, sides and a bottom, the top of the holder having an opening for receiving the cup within the holder and further having at least one flange extending radially inwardly at a position above and adjacent the position of a radially outwardly extending tab of the cup with the cup fully inserted into the holder, each flange having a limited circumferential dimension to permit insertion of the cup into the holder in one rotative position of the cup and to permit each flange to engage the upper surface of a tab in a second rotative position of the cup in the holder to secure the cup and the holder together.

21. The holder claimed in claim 20 in which the holder has a plurality of flanges.

22. The holder claimed in claim 21 in which the holder has a pair of flanges.

23. The holder claimed in claim 22 in which the flanges are on opposite sides of the holder.

24. The holder claimed in claim 20 in which each flange extends inwardly from the sides of the holder and is spaced above the bottom of the holder.

25. The holder claimed in claim 24 in which a boss or detent is provided on one surface of a flange.

26. The holder claimed in claim 25 in which said boss or detent comprises a radially extending rib or groove.

* * * * *